US006113442A

United States Patent [19]

Nakamura

[11] Patent Number: 6,113,442

[45] Date of Patent: Sep. 5, 2000

[54] INDICATOR ARRANGEMENT FOR MARINE PROPULSION ENGINE

[75] Inventor: Kazuhiro Nakamura, Hamamatsu, Japan

[73] Assignee: Sanshin Kogyo Kabushiki Kaisha, Hamamatsu, Japan

[21] Appl. No.: 09/137,323

[22] Filed: Aug. 20, 1998

[30] Foreign Application Priority Data

Aug. 20, 1997 [JP] Japan ..... 9-223312

[51] Int. Cl.[7] ..... B63H 21/22

[52] U.S. Cl. ..... 440/1; 440/84; 440/87

[58] Field of Search ..... 440/1, 2, 87, 88, 440/84

[56] References Cited

U.S. PATENT DOCUMENTS 4,938,721 7/1990 Koike ..... 440/1
5,136,279 8/1992 Kanno ..... 440/1

*Primary Examiner*—Jesus D. Sotelo
*Attorney, Agent, or Firm*—Knobbe, Martens, Olson & Bear LLP

[57] ABSTRACT

A marine propulsion engine abnormal condition sensing arrangement, specifically a low oil pressure sensor, that is effective to permit a low cost sensor by using a separate power supply circuit that need not pass through the main watercraft control in order to drive the switch. The warning device that is operated by the switch is provided with a separate power supply so that its characteristics need not determine the current that is supplied to the sensor.

9 Claims, 7 Drawing Sheets

INDICATOR ARRANGEMENT FOR MARINE PROPULSION ENGINE

BACKGROUND OF THE INVENTION

This invention relates to an indicator arrangement for a marine propulsion engine and more particular to an improved oil pressure warning indicator for a marine propulsion system.

In many forms of marine propulsion systems, there are provided certain warnings, indicators or warning devices positioned in proximity to the operator's area that provide an indication to the operator that there is a malfunction in the engine propulsion system. For example, in watercraft powered by outboard motors having four cycle engines, there may be provided an oil pressure warning light or other type of warning device that gives a signal to the operator when the engine oil pressure falls below a predetermined value. The types of devices provided for this purpose heretofore, however, have had a problem in that the sensitivity of the oil pressure switch is such that improper signals may be given and/or it may be necessary to replace the switch more frequently than is desired.

The problem dependent with this prior art type of construction can be understood by reference primarily to FIGS. 1 and 2 which show, respectively, the type of circuitry employed for this purpose in the prior art and the type of oil pressure switch utilized, which is shown partially and in cross-section.

Referring specifically to FIG. 1, the reference numeral 11 indicates schematically the outboard motor and specific components of it are shown in electrical diagram form. The outboard motor 11 is connected to the hull of an associated watercraft which is indicated at 12 for propelling it in a manner known in the art.

Associated with the outboard motor 11 is a magneto generator or alternator, indicated generally by the reference numeral 13, which includes a charging coil 14 in which an electrical current is induced. This current is transferred through a rectifier diode bridge 15 and a quick disconnect electrical coupling 16 to the watercraft hull 12 for charging a battery, indicated at 17, through a hull side electrical circuit, indicated at 18. This electrical circuit 18 also provides power to other hull side devices.

The electrical circuit includes a main switch 19 by which electrical power is transmitted to an ignition control circuit 21 of the outboard motor through a further quick disconnect electrical connector 22. The ignition control circuit 21 includes an arrangement which fires a group of spark plugs 23 by energizing the primary windings of spark coils 24 in a manner that is well known in this art. Pulser coils 25 of the magneto generator provide timing signals by which the ECU 21 controls the timing of firing of the spark plugs 23 in any conventionable manner.

A kill switch 26 is also mounted within the watercraft hull 12 for discontinuing the operation of the engine, for example, by grounding out the ignition circuit of the ECU 21 in a manner also known in this art.

The electrical power supplied by the rectifier circuit 13 to the watercraft hull 12 is utilized to power various loads indicated schematically at 27 and other devices as indicated also in this figure. Among these loads is an oil pressure warning light 28 or other type of warning device that provides an indication to the watercraft operator when the oil pressure of the engine or some other condition is not within a predetermined value. Specifically with a low oil pressure warning, this oil pressure signal is sent by a switch, indicated at 29, and which is shown in cross-section in FIG. 2.

As may be seen, the switch 29 is comprised of a housing having a base piece 31 and a main housing piece 32, which pieces define a pressure chamber 33. The base piece 31 is tapped into the engine body and has a pressure sensing port 34 to which oil circulated by the engine lubricating systems is delivered through a suitable conduit.

A switch comprised of a fixed terminal 35 and a movable terminal 36 are provided in the cavity 33 and sense the oil pressure from the line 34. A coil compression spring 37 urges the movable terminal 36 into contact with the fixed terminal 35. This spring 37 also provides an electrical connection to a conductor 38 which is connected to the ground as shown schematically in FIG. 1.

When the oil pressure is above a predetermined level, the movable switch element 36 will be biased away from the fixed contact 35 and the electrical circuit which passes through the indicator light 28 will be open. However, if the oil pressure falls below this predetermined value, the spring 37 will urge the movable contact 36 into contact with the fixed terminal 35 to ground this circuit so that the light 28 will be illuminated.

There are two rather distinct problems with this type of prior art construction. The first is that the electrical current that is applied to the terminals 35 and 36 is basically the same as the amount of electrical current that can pass through the warning light 28 to maintain it in its illuminated condition. Thus, the characteristics and limitations of the lamp 28 determines the maximum current flow that can pass through the switch 29.

This is disadvantageous because of the fact that the terminals will deteriorate with time and, accordingly, the switch may become inoperable. Because the terminal contacts 35 and 36 are continuously immersed in oil, the surfaces can become oxidized over time or fatigue of the spring may weaken it to cause the conductivity between the terminals to become deteriorated. Although this problem can be solved by increasing the current flow, as noted, this is limited by the lamp 28 and thus is not a feasible alternative.

Of course, higher quality or non-corrosion resisting terminals, such as gold-plated or gold terminals can be employed, but this makes the cost of the sensor 29 too high.

It is, therefore, a principle of object of this invention to provide an improved indicator arrangement for a marine propulsion unit wherein the sensing switch can be supplied with a higher current flow than that which actually actuates the warning device.

It is a further of object of this invention to provide an improved indicator arrangement for a marine propulsion unit wherein the sensing switch is supplied with a source of electrical current that can be different than that which actually actuates the warning device.

SUMMARY OF THE INVENTION

This invention is adapted to be embodied in a warning device for a marine propulsion device comprising an engine and a propulsion unit driven by the engine for propelling an associated watercraft with which the propulsion device is associated. The watercraft is provided with a control area where a warning device is positioned. An engine condition warning switch is mounted on the engine to sense an engine condition. This switch is connected to a first electrical circuit that is powered by an electrical power source associated with the engine. The warning light, on the other hand, is powered by a power source located within the hull.

DETAILED DESCRIPTION OF THE PREFERRED EMBODIMENT

Figure 3:
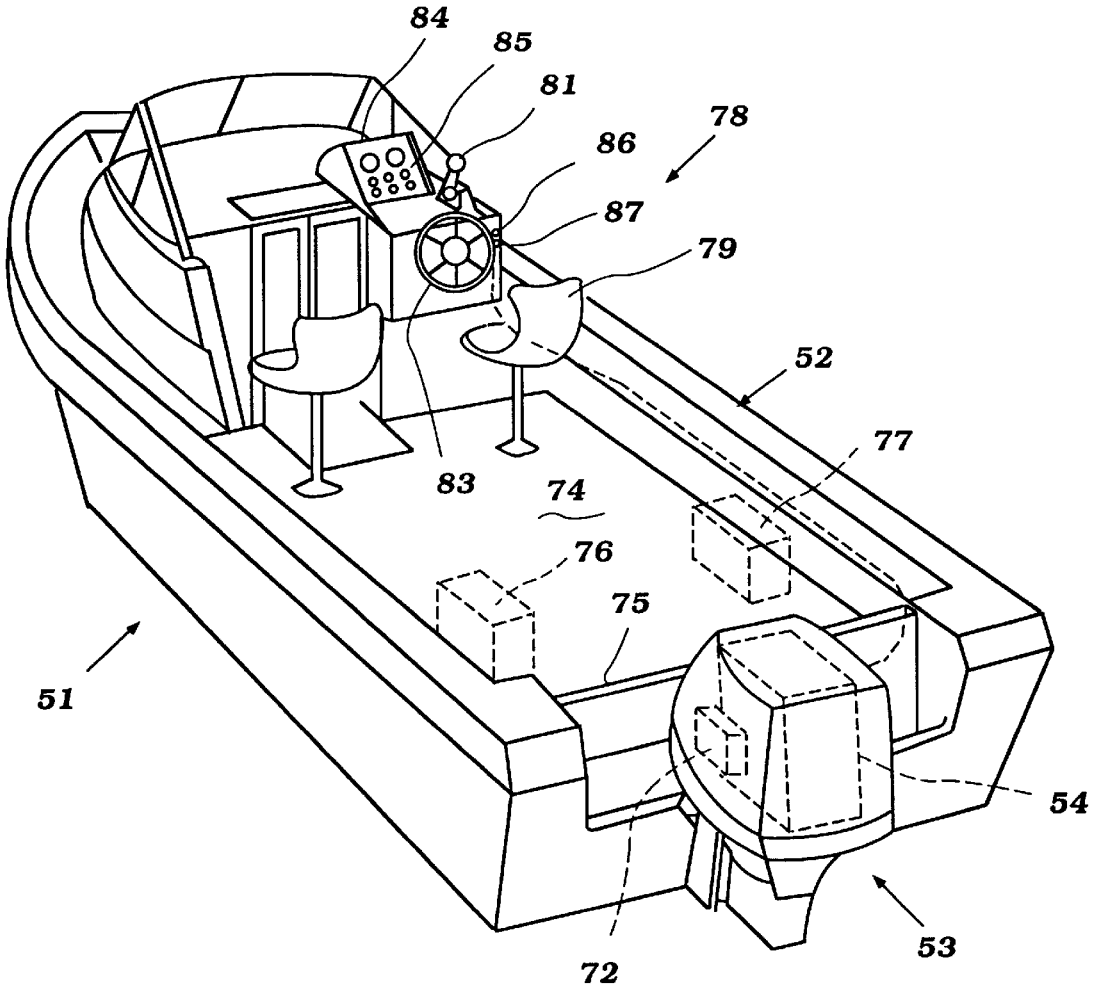
FIG. 3 is a perspective view showing a watercraft having a propulsion system employing a warning device constructed in accordance with an embodiment of the invention.
Figure 4:
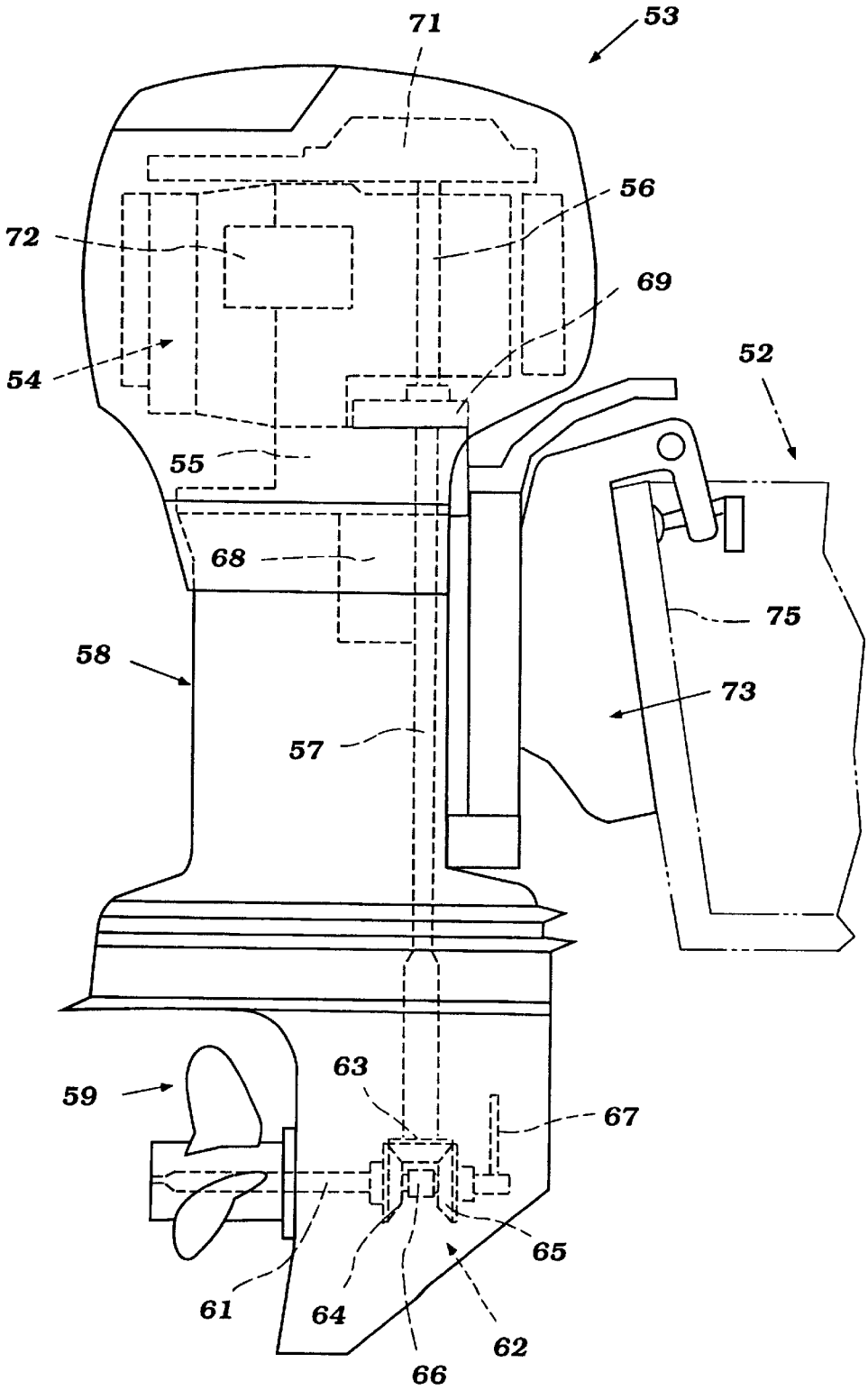
FIG. 4 is a side elevational view of the watercraft showing a rear portion of the watercraft in phantom and the associated propulsion unit in solid lines.

Referring now in detail to the drawings and initially to FIGS. 3 and 4, a watercraft having a propulsion system and warning device constructed in accordance with an embodiment of the invention is indicated generally by the reference numeral 51. The watercraft hull is indicated generally by the reference numeral 52, while its propulsion device, an outboard motor in the illustrated embodiment, is indicated generally by the reference numeral 53.

Referring specifically to FIG. 4, the outboard motor 53 is comprised of a power head that consists of a powering internal combustion engine 54. In this embodiment, the engine 54 is depicted as being of the four cylinder, inline type and operates on a four stroke principle. Although the invention is described in conjunction with such an engine type, it should be readily apparent that the invention can be utilized with a wide variety of types of engines having different cylinder numbers and different configurations. The invention relates to an engine condition warning system and, in the illustrated embodiment, an oil pressure warning system, and thus a four cycle engine is a typical embodiment with which the invention can be employed.

As is typical with outboard motor practice, the engine 54 is mounted in the power head of the outboard motor on an exhaust guide plate 55 so that the engine crankshaft 56 rotates about a vertically extending axis. This is done so as to facilitate coupling of the engine crankshaft 56 to a driveshaft 57 that depends into a driveshaft housing and lower unit 58 in which a propulsion device, indicated generally by the reference numeral 59 and, in this embodiment, a propeller is journaled for rotation.

The drive shaft 57 drives a propeller shaft 61 to which the propulsion device 59 is affixed through a forward neutral reverse transmission, indicated generally by the reference numeral 62. This transmission 62 includes a driving bevel gear 63 that is affixed to the lower end of the drive shaft 57. This driving bevel gear 63 is enmeshed with a pair of driven bevel gears 64 and 65. The driven gears 64 and 65 are journaled on the propeller shaft 61 and rotate in opposite directions due to their diametrically opposed engagement with the driving bevel gear 63.

In order to drive the propeller shaft 61 and propeller 59 in selected forward reverse directions, a dog clutching element 66, which has a splined connection to the propeller shaft 61. The dog clutching element 66 is moved into engagement with corresponding dog clutching teeth formed on the driven bevel gears 64 and 65. This shifting motion is accomplished by a shift rod 67 under control by the watercraft operator in a manner to be described. This type of transmission is well known in the art, and, for that reason, further discussion of it is not believed to be necessary to permit those skilled in the art to practice the invention.

Continuing to refer primarily to FIG. 4, the engine 54 is provided with a lubricating system which includes an oil tank or reservoir 68 that is mounted on the underside of the exhaust guide plate 55 and which depends into the upper end of the drive shaft housing 58. Lubricant is drawn from this oil tank 68 by an oil pump 69 which is driven off the lower end of the crankshaft 56. This lubricant is then delivered to various components of the engine, as will be described shortly by reference to FIG. 5.

The engine 54 is also provided with a flywheel magneto 71 that is driven off of the upper end of the crankshaft 56. This flywheel magneto 71 supplies electric power, in a manner which will be described later by reference primarily to FIG. 6, to an electrical system that includes an ECU 72 that controls certain engine functions, including the firing of the spark plugs for the engine 57.

A combined clamping and swivel bracket assembly, indicated generally by the reference numeral 73 mounts the outboard motor 53 on the watercraft transom 52 for steering movement about a vertically extending axis and for tilt and trim movement about a horizontally extending axis. The relationship to the outboard motor 53 to the watercraft hull 52 will now be described by primary reference to FIG. 3.

The watercraft hull 52 is shown in more detail in FIG. 3 and includes a generally centrally positioned passengers area 74 forwardly of the watercraft transom 75 upon which the outboard motor 53 is mounted by the combined clamping and swivel bracket assembly 73.

In the gunnels at the side of the passengers area 74, there are provided certain auxiliaries, such as a fuel tank 76 and one or more storage batteries 77. At the front of the passengers area 74, there is provided an operator station, indicated generally by the reference numeral 78 and which includes an operator seat 79 that is positioned behind a control panel.

This control panel includes, among other things, a single lever throttle and transmission control 81, of a known type, and a steering control 83. These controls 81 and 83 are connected to the outboard motor 53 by suitable control mechanisms such as wire actuators. The throttle control portion of the single lever control 81 controls the speed of the engine through any type of known throttle mechanism. The transmission control portion of this single lever control controls the shift rod 67 for effecting shifting of the transmission 62 in the manner already described. The steering control 83 controls the steering of the outboard motor 53 about a vertically extending steering axis.

There is also provided an instrument panel 84 forwardly of the seat 79 and which contains a number of gauges and displays, including an oil pressure warning display 85 which forms the subject of the invention. Finally, the control panel also mounts a main switch 86 and a kill switch 87. The relationship of these switches and controls will be described shortly, primarily by reference to FIG. 6.

Figure 5:
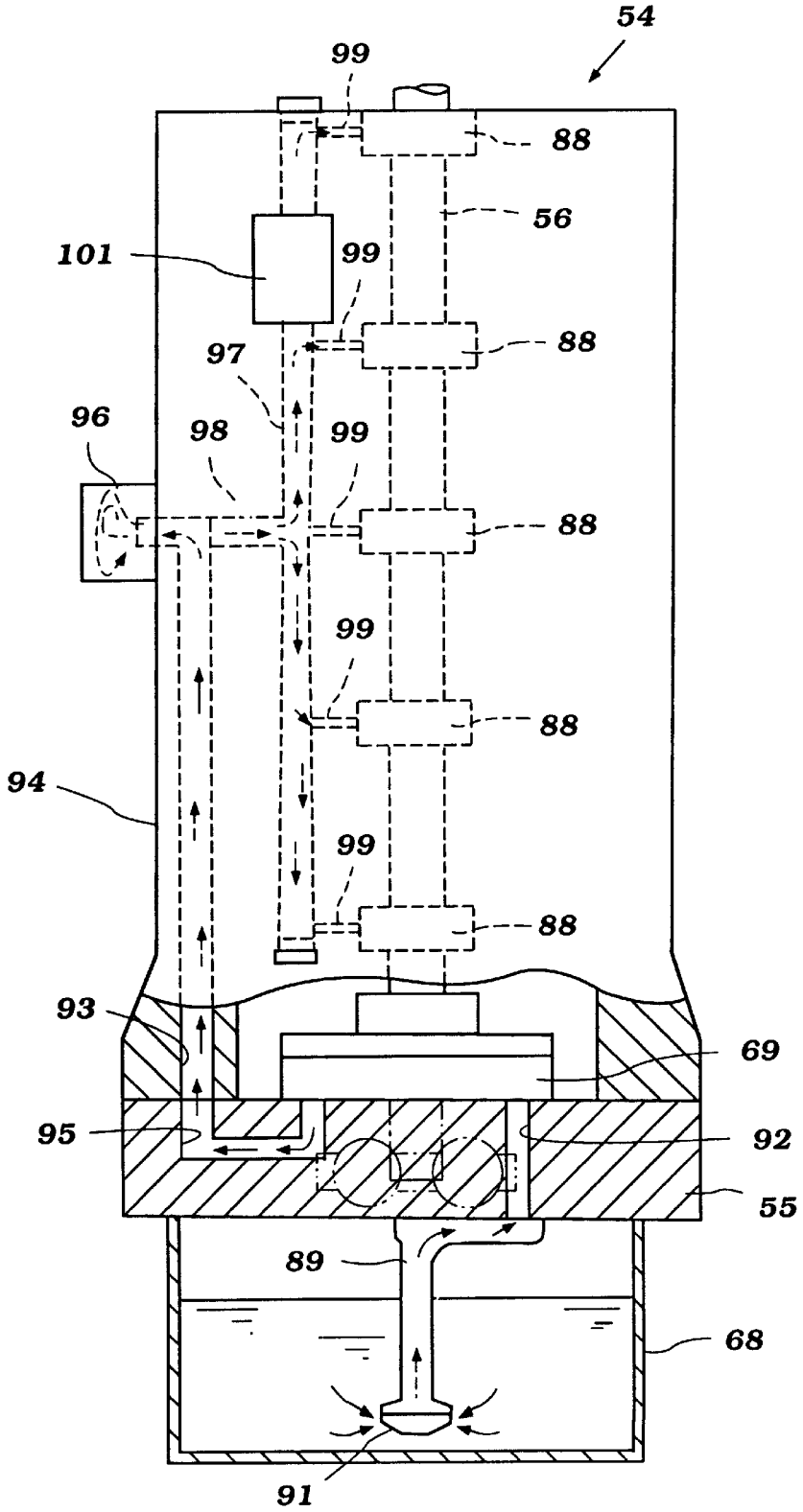
FIG. 5 is a schematic view showing the lubrication system for the engine of the outboard motor.

The engine lubricating system is shown partially in FIG. 5 and will be described primarily by reference to that figure.

It should be noted that only the lubricating system for the engine crankshaft 56 is illustrated, and this includes its main bearings 88 which are journaled in the crankcase assembly of the engine 54 in any known manner. It should be understood that in addition to lubricating the main bearings 88 of the crankshaft 56, this lubricating system also lubricates the camshaft or camshafts of the engine 54 and such other components as are normally lubricated in an engine through a normal lubricating system.

The oil pump 86 draws oil from the oil tank 68 through a pick up tube 89 which has a strainer element 91 at its lower end. This pick up tube 89 communicates with the oil pump 69 through a supply passage 92 that is formed in the exhaust guide plate 55.

The oil pump 69 outputs the pressurized lubricant to a main oil gallery 93, which may be formed in a crankcase member 94 of the engine 54. Oil is delivered to this main gallery through a delivery passage 95 formed in the exhaust guide plate 55.

The main gallery 93 delivers the oil to an oil filter 96 which is mounted on the crankcase member 94 in a suitable manner. Filtered oil is delivered to main lubricating gallery 97 in the crankcase member 94 through an oil filter discharge passage 98. This gallery 97 is cross-drilled at 99 so as to supply lubricant to the main bearings 88 in a generally conventional manner.

Figure 1:
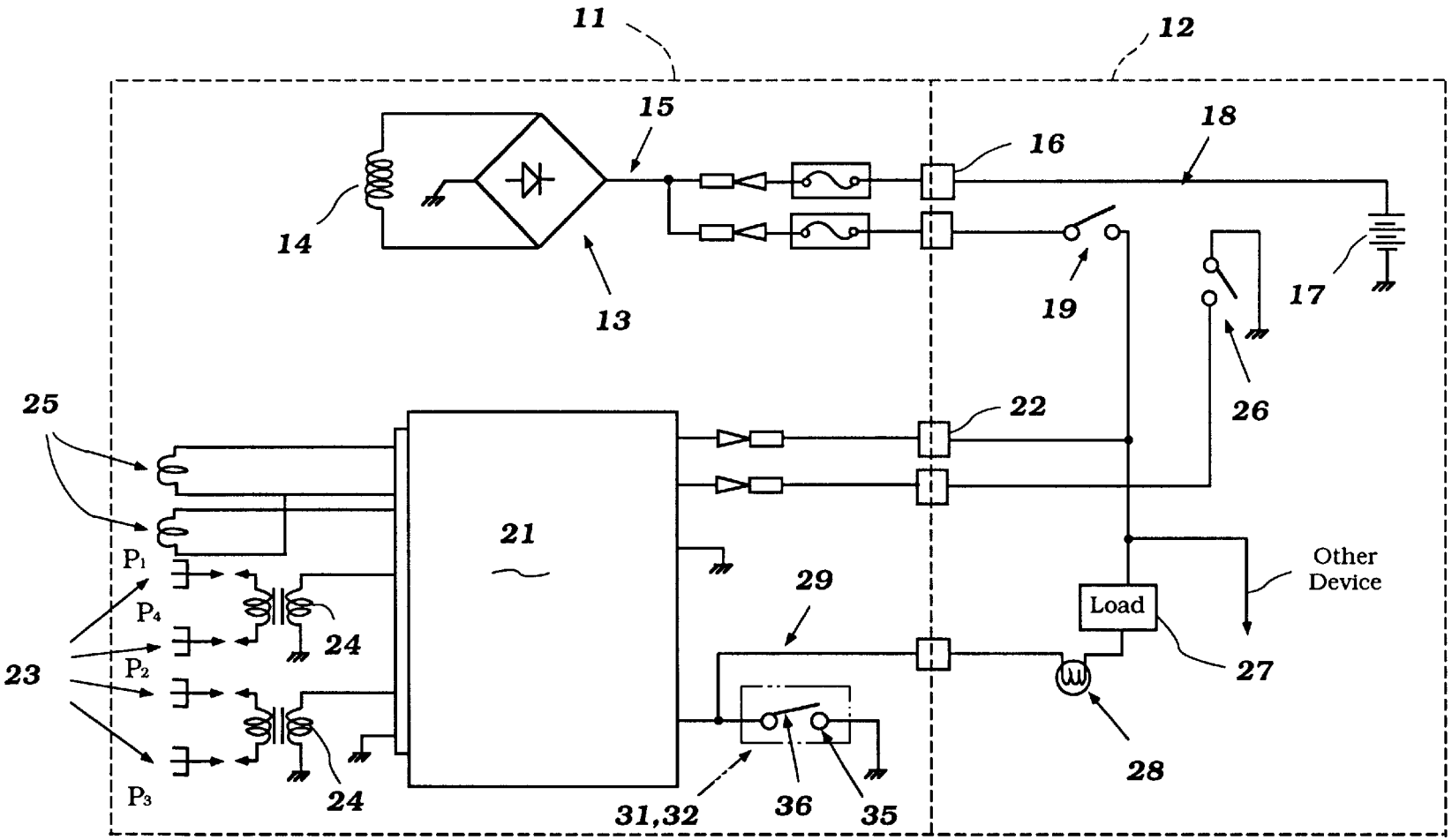
Figure 1 (Prior Art)
FIG. 1 is a partially schematic, primarily electrical, view showing a prior art type of marine propulsion system utilizing a prior art type of engine condition warning arrangement.
Figure 2:
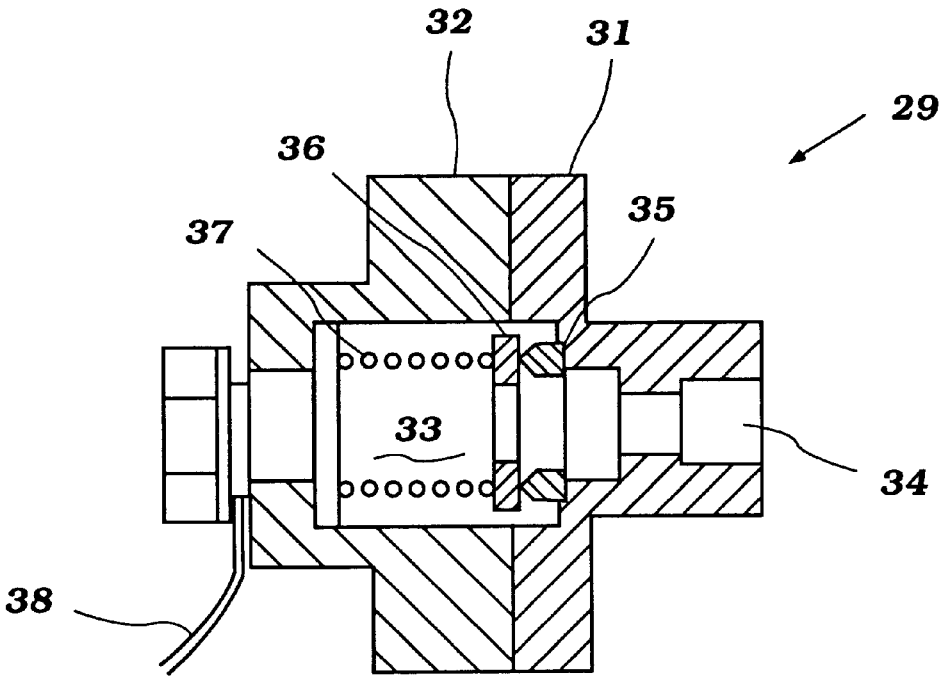
Figure 2 Prior Art
FIG. 2 is the pressure responsive switch utilized with the prior art type of construction and which can also be employed in connection with the invention.

In accordance with the invention, an oil pressure sensing switch 101, which may have a construction the same as the prior art type of construction shown in FIG. 2, is suitably mounted in the oil system in communication with the main delivery gallery 97.

Figure 6:
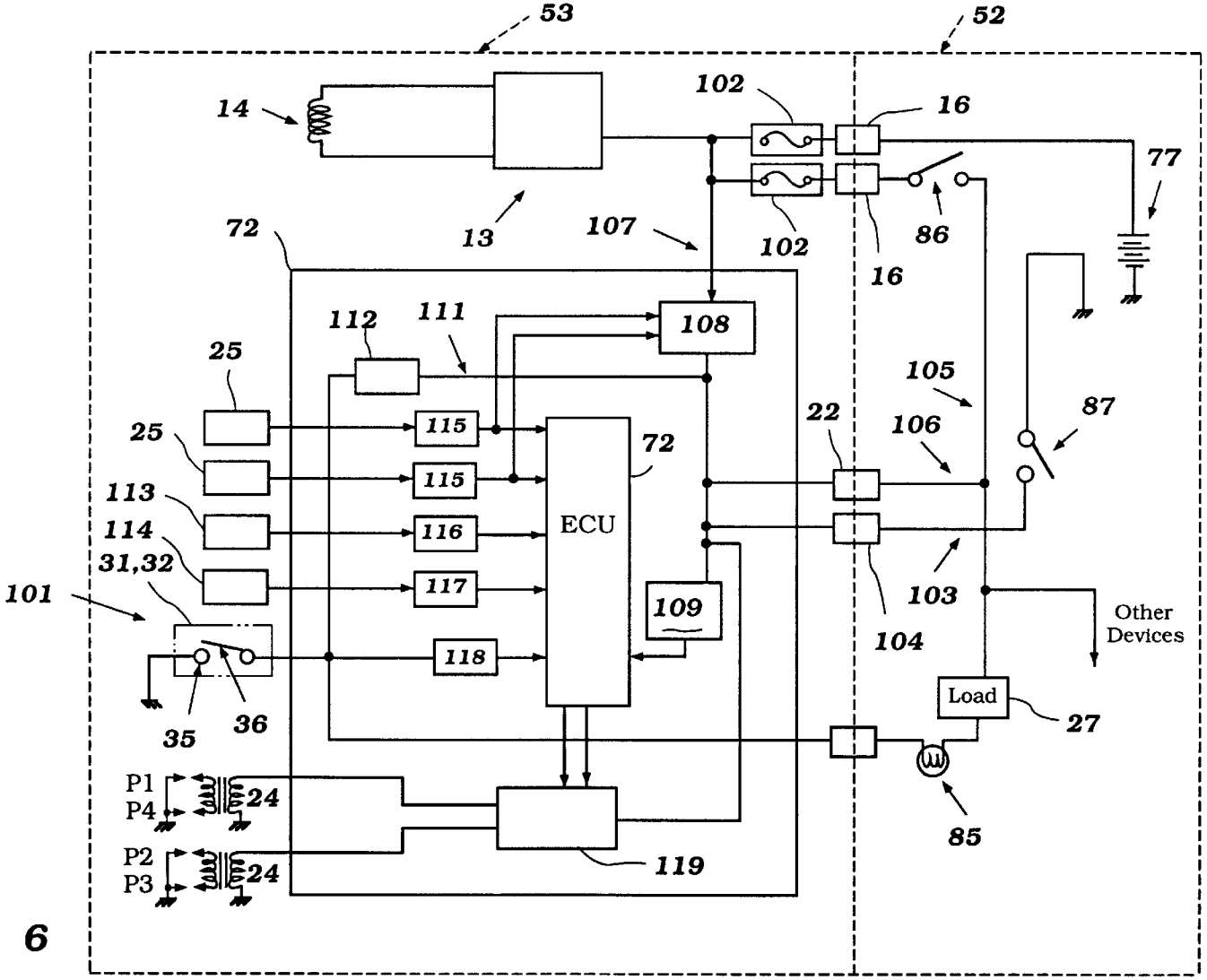
FIG. 6 is a schematic, primarily electrical view, in part similar to FIG. 1, but showing the invention.

Having thus described the general environment in which the invention is employed, the actual construction which embodies the invention will now be described by reference to FIGS. 6 and 7.

Figure 7:
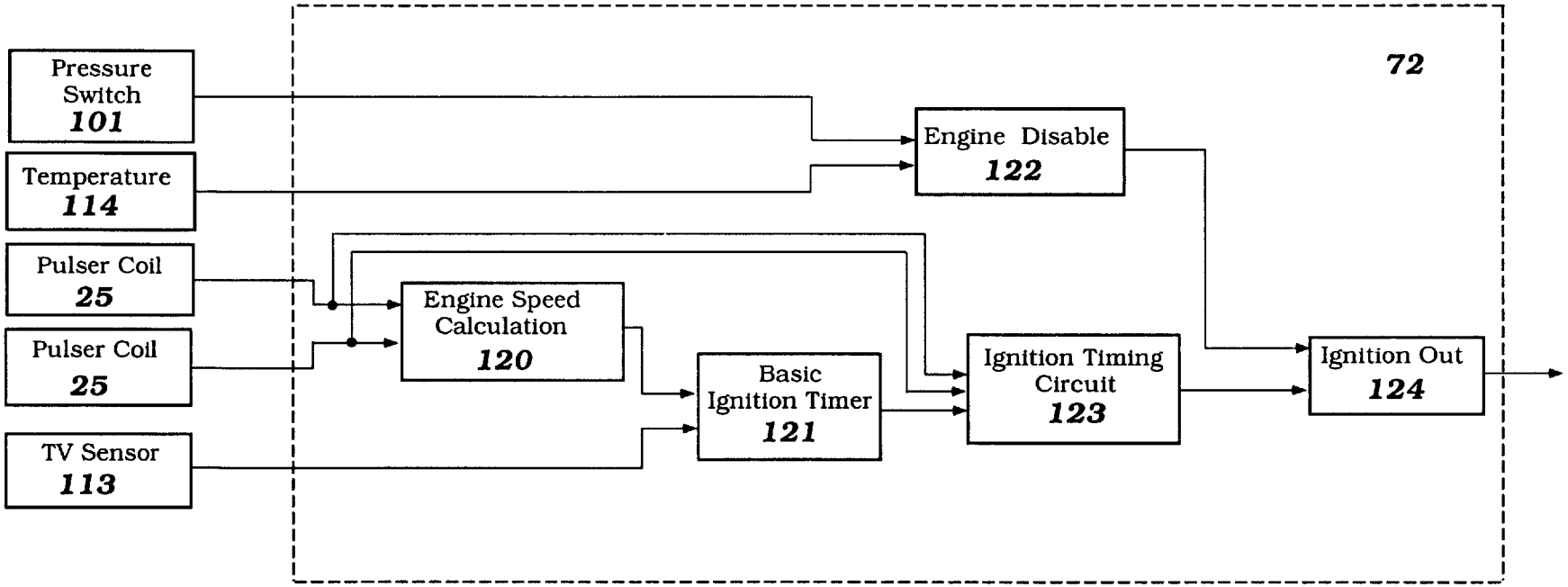
FIG. 7 is a more schematic view showing the relationship of various components of the ECU in this embodiment.

Referring first primarily to the electrical schematic of FIG. 7, certain components associated therewith are the same as those of the prior art type of construction. In some of the instances where that is the case, those components have been identified by the same reference numerals, and those components will be described again only insofar as is necessary to understand their relationship with the embodiment of the invention.

Thus, the charging coil 14 still outputs its signal to a rectifier or regulator 13 that may include a diode bridge and which supplies power through the connectors 16 and interposed fuses 102, shown previously but not previously numbered. These go to the battery 77 and main switch 86 as would the prior art type of construction.

In addition, the kill switch 87 is connected through a conductor 103 and connector 104 to the ECU 72 as previously described. In addition, a main power supply line 105 is connected back to the ECU 72 through the previously noted conductor 22 from a branch circuit 106. The main switch 86 also connects the line 105 to the load 27 and warning light 85. However, this line 105 does not supply electrical power to the pressure switch 101 of this embodiment, as will become apparent shortly.

In this embodiment, on the outboard motor side 53, the regulator 13 supplies electrical power directly through a conductor 107 to an engine side non-contact switch circuit 108. This switch circuit 108 supplies electrical power to the ECU 73 through a constant voltage circuit 109.

In addition, a branch circuit 111 supplies unregulated voltage to the pressure responsive switch 101 through a load 112 which is chosen so that the desired current flow can be supplied to the switch 101 so as to ensure adequate current flow even if the contacts 35 and 36, 101, become corroded.

However, the switch 101, when grounded, will cause the light 85 to be illuminated by the regulated voltage transmitted through the line 105 on the engine side so that this current flow can be set so as to accommodate the characteristics of the warning device 28 without affecting the current flow through the switch 101.

In addition to the pulsar coils 25, other engine controls are transmitted to the ECU 72, and these include signals from a throttle position detector 113 and coolant temperature detector 114. The outputs from the detectors 25, 113 and 114 are all transmitted to the ECU 72 through respective input circuits 115, 116 and 117 and the switch output is also transmitted to the ECU 72 through an input circuit 118.

The ignition control circuit is also shown in this figure, and is identified by the reference numeral 119.

The way the signals from the various sensors are processed within the ECU 72 will now be described by reference to FIG. 7. As seen in this figure, the pulser coils 25 output their signals to an engine speed calculation part 120 of the ECU 72 that takes the pulse signals and divides them by time to obtain an engine speed signal.

This signal is outputted along with the signal from the throttle position sensor 113 to a basic ignition timing map circuit 121. The outputs from the oil pressure sensor 101 and the engine temperature sensor 114 are outputted to a disabling controlled part 122 which determines if engine disabling is required due to the fact that there is an abnormally low oil pressure or an abnormally high engine temperature.

In addition, the basic ignition timing signal from the map 121 and the pulsar coils outputs from the pulsar coils 25 are transmitted to an ignition timing circuit that determines the appropriate ignition timing and the signals from the circuits 123 and 122 are transmitted to an ignition output circuit 124.

If the engine disabling is not required, the output circuit 124 merely outputs the signal from the timing circuit 123 to the ignition circuit 119 for its firing. On the other hand, if engine disabling is required, the firing of the spark plugs is either totally discontinued or partially disabled so as to permit the engine either to be stopped or to operate it at a reduced limp home speed.

Thus, it should be readily apparent that the described construction permits the use of a low cost oil pressure sensor that can be supplied with a separate power circuit so as to provide the necessary current flow for effective signals without being limited by the characteristics of the warning device which it operates.

What is claimed is:

1. A warning device for a marine propulsion device comprising an engine and a propulsion unit driven by said engine for propelling an associated watercraft with which said propulsion device is associated, said watercraft being provided with a control area where a warning device is positioned, an engine condition warning switch mounted on said engine to sense an engine condition, said warning switch being connected to a first electrical circuit that is powered by an electrical power source driven by said engine, and a second electrical circuit located within the watercraft hull for operating said warning device when said warning switch is operated.

2. A warning device as set forth in claim 1 wherein the warning switch senses engine lubricant pressure.

3. A warning device as set forth in claim 1 wherein the warning device comprises a light.

4. A warning device as set forth in claim 3 wherein the warning switch senses engine lubricant pressure.

5. A warning device as set forth in claim 1 wherein the first and second electrical circuits are in parallel with each other.

6. A warning device as set forth in claim 5 wherein the first electrical circuit passes greater electrical current than the second electrical circuit.

7. A warning device as set forth in claim 6 wherein the warning switch senses engine lubricant pressure.

8. A warning device as set forth in claim 6 wherein the warning device comprises a light.

9. A warning device as set forth in claim 8 wherein the warning switch senses engine lubricant pressure.

* * * * *